United States Patent [19]

Hou

[11] Patent Number: 5,021,934

[45] Date of Patent: Jun. 4, 1991

[54] EASY TURNING ON/OFF FLASHLIGHT

[76] Inventor: Hsisn-Der Hou, No. 5, Alley 279, Chung Cheng Rd., Yung Kang Hsiang, Tainan Hsien, Taiwan

[21] Appl. No.: 574,731

[22] Filed: Aug. 30, 1990

[51] Int. Cl.[5] ..... F21L 15/00

[52] U.S. Cl. ..... 362/187; 362/158; 362/205

[58] Field of Search ..... 362/158, 187, 202, 205, 362/206

[56] References Cited

U.S. PATENT DOCUMENTS

| | | | |
|---|---|---|---|
| 4,504,890 | 3/1985 | Chan | 362/205 |
| 4,733,337 | 3/1988 | Bieberstein | 362/206 |
| 4,807,097 | 2/1989 | Gammache | 362/205 |
| 4,841,417 | 6/1989 | Maglica et al. | 362/206 |
| 4,888,670 | 12/1989 | Sharral | 362/205 |
| 4,939,628 | 7/1990 | Wang | 362/206 |

*Primary Examiner*—Ira S. Lazarus

*Assistant Examiner*—Richard R. Cole

*Attorney, Agent, or Firm*—Morton J. Rosenberg; David I. Klein

[57] ABSTRACT

An easy turning on/off flash light and in particular to one by pressing the flashlight head downwardly, to turn the flashlight on/off and no needs to use finger to press switch. This particular flashlight comprises a bulb-holder section, a restoring spring, a housing which mainly has a linking section and an engaging section and with the general parts, a lens, a flashlight head, a housing, a battery and a battery cover that this invention can perform its best performance which by pressing the flashlight head down, the linking section will bring the engaging section to spin to an angle where the engaging section will slide through a guide-rail and catched by a catch trough. Each time the flashlight head is pressed down, the engaging section will move to the next catch trough.

4 Claims, 5 Drawing Sheets

ON

OFF

EASY TURNING ON/OFF FLASHLIGHT

BACKGROUND OF THE INVENTION

Flashlight is definitely an important necessity to people such as walking at night time, looking for something in a dark place . . . etc., and many inventors have being tried to improve its functions to make it more perfect. However, all such improvements mostly fall into the areas of illumination, moisture proofing and the switch. It is the switch that this invention relates to as we understand that most of the improvements on the switch generally fall into the methods of operating the switch such as by pushing a switch, by pressing a switch or by turning the head to turn the light on/off which are convenient most of the time but not when a person has his hands full, or when climbing a mountain with both hands holding a rope, or even to someone who is disabled or has had a stroke . . . etc.

The inventor has therefore invented this invention which may be turned on/off by pressing the flaslight head down.

SUMMARY OF THE INVENTION

It is the primary object of the present invention to provide an easy turning on/off flaslight which has good conductibility. The negative is constantly grounded and the positive not only has the bottom end of the conducting spring connected to the upper end of the conducting post but also has the rest of the parts in constant conduction. The conducting spring may have its lower portion longer (the size is intentionally left longer when manufactured) to make up the size insufficiencies of other parts, and therefore, the bottom end touches the upper end of the conducting post owing to the elastic force.

It is another object of the present invention to provide an easy turning on/off flashlight which is easy to operate by pressing the flashlight head to turn the light on or off.

It is a still another object of the present invention to provide an easy turning on/off flashlight which is waterproof in rain or shallow water and is suitable for outdoor activity.

It is a further object of the present invention to provide an easy turning on/off flashlight which light may be changed either to flood or spot by turning its flashlight head.

It is another further object of the present invention to provide an easy turning on/off flashlight which operating method is different from finger operating type, the press type is more convenient to some man who is hand disabled or whose hands are full with tools . . . etc.

DETAILED DESCRIPTION OF THE PREFERRED EMBODIMENT

Figure 1:
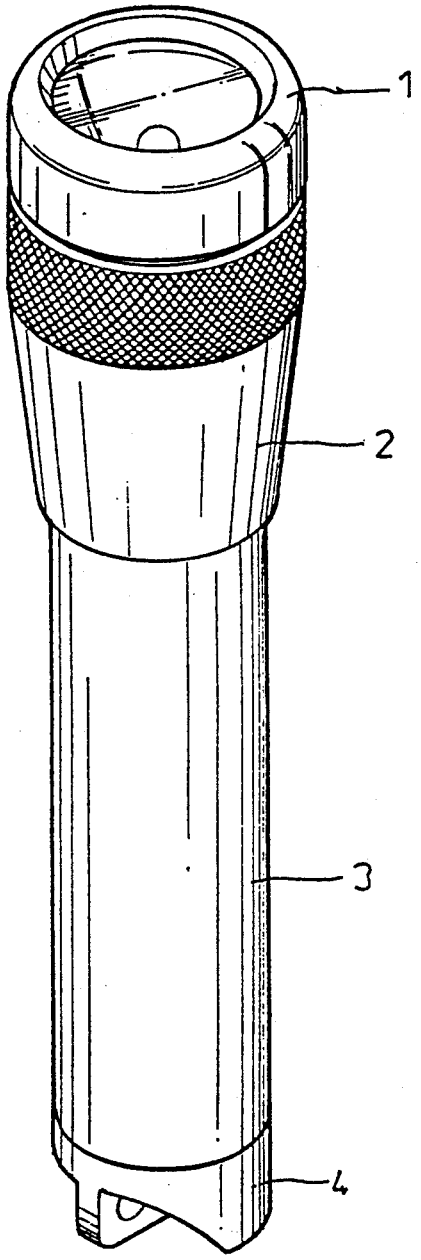
FIG. 1 is a perspective view of the present invention.
Figure 2:
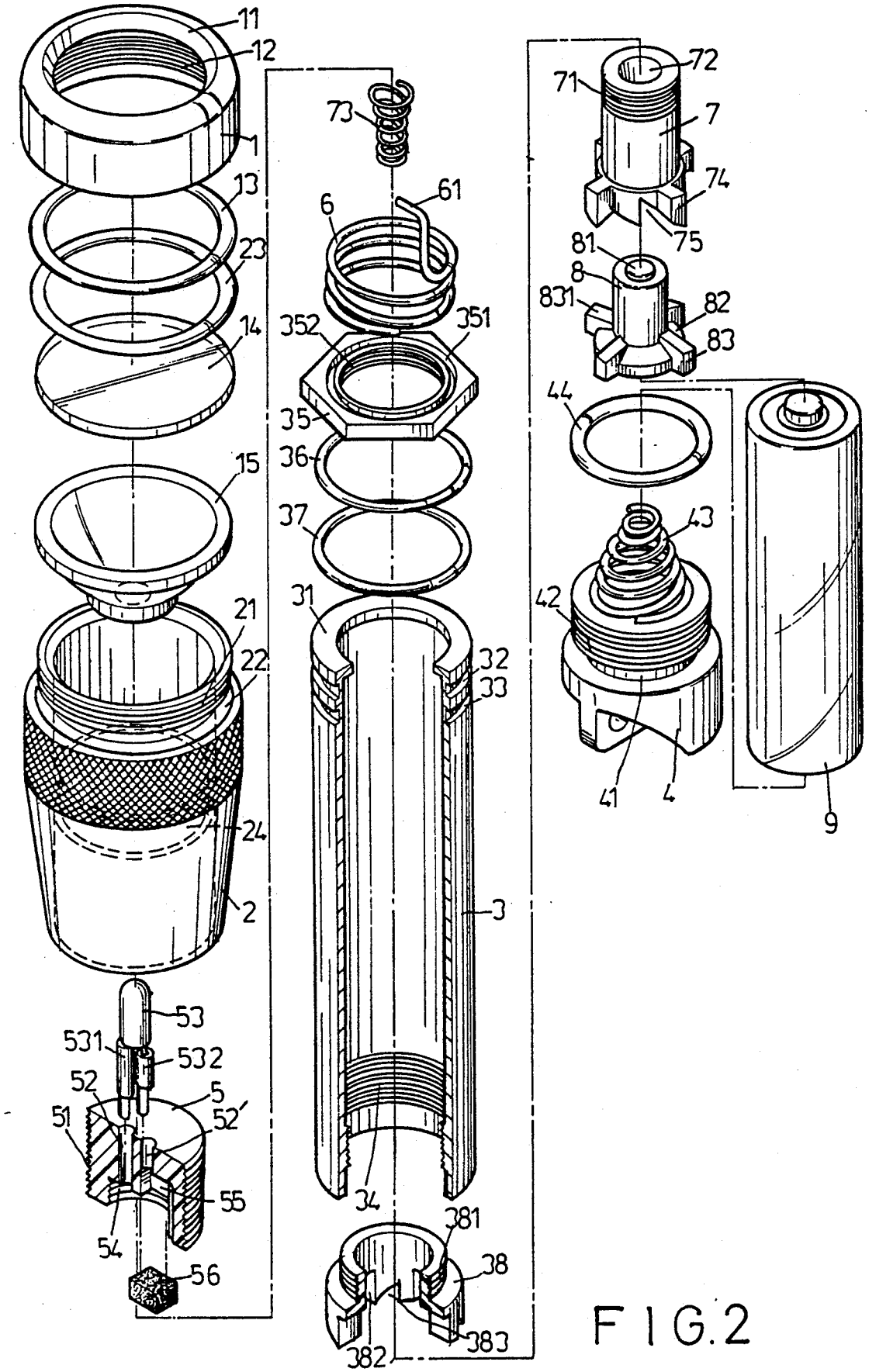
FIG. 2 is a fragmentary perspective view of the present invention.

The present invention, according to the FIG. 1 and 2, comprises a lens assembly 1, a flashlight head 2, a bulbholder section 5, a restoring spring 6, a housing 3, an linking section 7, a engaging section 8 and a battery cover 4. The lens assembly 1 has a shoulder 11 and a female thread 12, O rings 13, a lens 14 and a conical shaped reflector 15. The flashlight head 2 is a hollow body and has a male thread 21 at its upper position, a circular trough 22, an O ring 23 and a female thread 24 at its inner middle position. The bulbholder 5 has a barrel shaped body with a hole at its inner lower position a male thread 51, two holes 52 and 52' which connected separately with two filaments 531 and 532, a female thread 54 located at its inner lower portion, a trough 55 which is used to accept an isolator 56. The restoring spring 6 is a cylindrical spiral spring as a conductor in this invention and has a foot 61. The housing 3 is a cylindrical body and has a cover ring 31 at its upper end, two troughs 32 and 33 at upper outside portion, a female thread 34 at lower inner end, a nut 35, two O rings 36 and 37 and a catch section 38 which is shaped like a barrel with its top cut out a portion and has male thread 381, several hollow troughs 382 and several shallow troughs 383. The linking section 7 is a hollow cylinder and has a male thread 381 at its outer upper portion, a through bore 72, a conducting spring 73 and several linking members 74 (in this example there are four pieces). Each of the linking members 74 has a slant 75 at its bottom with its end all the way extended to the bottom most. The engaging section 8 has also a cylindrical hollow body and has a conducting post 81 stretches out of both upper and lower ends, a plate 82 at its bottom, four engaging members 83 and each engaging members 83 has a slant 831 on top of it. The battery cover 4 has a trough 41, a male thread 42, a spring 43 and an O ring 44 placed inside of the trough 41.

Figure 3:
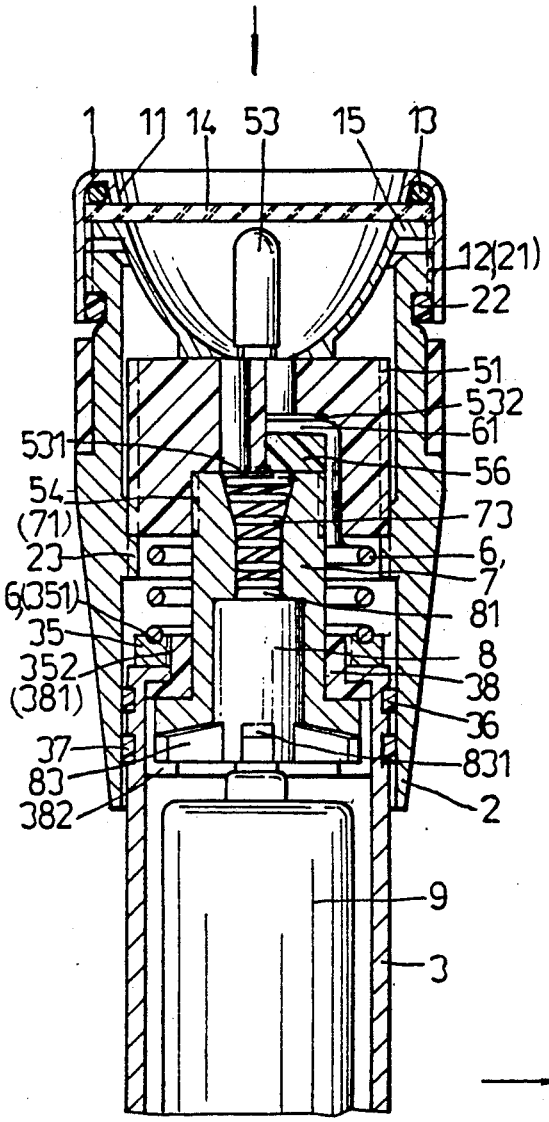
FIG. 3 is a cross-sectional view of the present invention at "ON" position.
Figure 4:
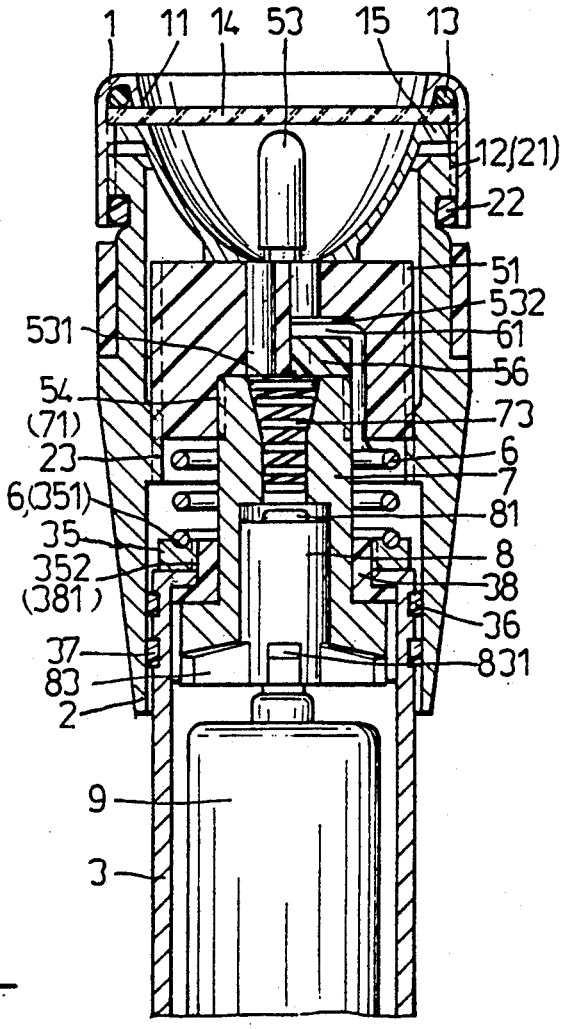
FIG. 4 is another cross-sectional view of the present invention at "OFF" position.

Reference may be continued with the FIGS. 3 and 4 to assembly, firstly place the two O rings 13 and 23 inside the lens assembly 1 against the shoulder 11, then push the lens 14 and the cornical reflactor 15 in sequence from bottom to top and threaded its female thread 12 with the male thread 21 of the flashlight head 2 securely. Secondly, insert the two filaments 531 and 532 of the bulb 53 through the two holes 52 and 52' into the bulbholder 5 then bend the filament 532 that through the hole 52' over and left inside of the trough 55, place the foot 61 of the restoring spring 6 in the trough 55 too and connected with the bent filament 532 and insert the isolator 56 into the trough 55 so that the filament 532 and the foot 61 are tightly connected with each other. The other filament 531 of the bulb 53 that left in the hole 52 may then be bent and isolated from the foot 532 by the isolator 56. Now thread the male thread 51 into the female thread 24 of the flashlight head 2 securely. Insert the catch block 38 into the housing 3 through its bottom to top until the lower thicker portion is stopped by the cover ring 31, screw the female thread 352 of the nut 35 onto the male thread 381 of the catch block 38 securely. Place the linking section 7 into the catch block 38 with its linking members 74 engage with either the hollow troughs 382 or the shallow troughs 383 and its upper male thread 71 may be threaded into the male thread 54 of the bulbholder 5 together and the upper end of its conducting spring 73 is tightly connected with the filament 531. The bottom ring of the restoring spring 6 is located in the ring trough 351 of the nut 35. Insert the engaging section 8 into the hollow body of the linking section 7 from bottom to top and the last step is to insert the battery 9 into the housing 3 and thread the battery cover 4 into the housing 3 and the assembly procedure thus completed.

Figure 5:
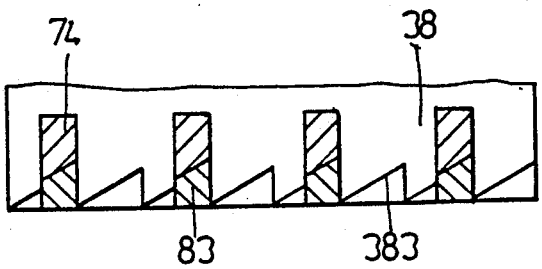
FIG. 5 is an enlarged cross-sectional view of catch blocks in connected with engaging members of the present invention which is at "ON" position.
Figure 9:
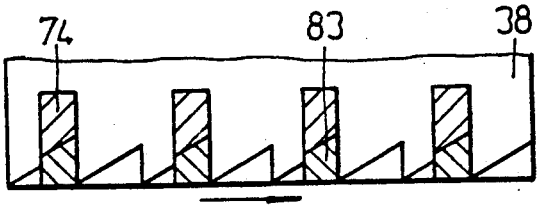
FIG. 9 is also similar FIG. 5.

When this invention is turned 'ON', shown as in FIG. 3, the positive current flows through the battery 9, conducting post 81, conducting spring 73 and connected to the filament 531 of the bulb 5. The other filament 532 is connected through the restoring spring 6, nut 35, housing 3, battery cover 4, a spring 43 and to the negative end of the battery 9 (The connection of the housing 3 . . . to the negative end of the battery 9 are not shown in this figure.). In FIGS. 5 and 9 have shown the relations between the linking section 7 and the engaging section 8 that the flashlight is at 'ON' position.

Figure 6:
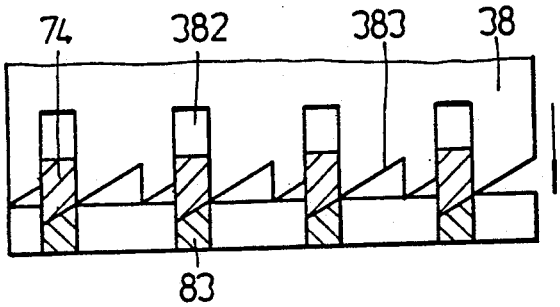
FIG. 6 is a same drawing as the FIG. 5 except the linking members are pushing the engaging section down.
Figure 7:
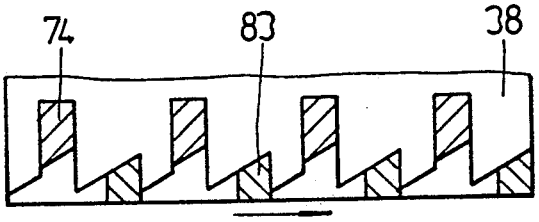
FIG. 7 is also a same drawing of FIG. 5 except the engaging section are sliding into troughs that do not connect with the engaging members.

When the flashlight head 2 is pressed down, the linking members 74, engaging members 83 and the catch blocks 38 are changing their connecting relations which is showing in the FIG. 6, upon the pressure on the flashlight head 2 is released, the engaging members 83 left the troughs 382 and slide into the troughs 382 that disconnect with the linking members 74, shown as in FIGS. 6 and 4, which show that the flashlight switch is at 'OFF' status.

Figure 8:
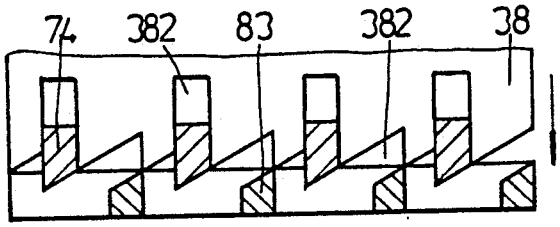
FIG. 8 is similar FIG. 6.

If we repeat the above procedure, the engaging members 83 will depart from the troughs 382 again (shown as in FIGS. 8 and 6) and return to the troughs 382 (shown as in FIGS. 9 and 5).

Figure 10:
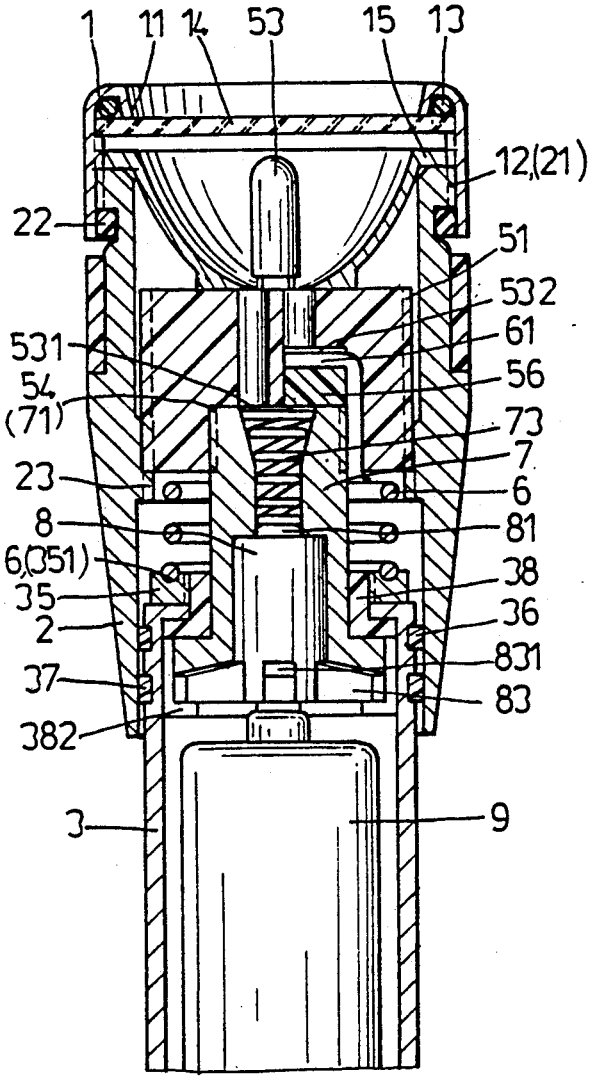
FIG. 10 is another cross-sectional view of the present invention showing beam adjustment.

It is also possible to change the focus of the bulb 53 (shown as in FIG. 10) by turning the flashlight head 2 either to flood or spot. Another feature on his invention is that all O rings 13, 23, 36, 37 and 44 are to make this invention waterproof. The two O rings 36 and 37 are adopted to make the head 2 easier to slide on the housing 3 when pressed.

I claim:

1. An easy turning on/off flashlight comprising:

a lens assembly having a shoulder, a female thread being connected with a male thread of a flashlight head, two O rings, a lens and a conical shaped reflector; said flashlight head having a hollow body, a circular trough and a female thread;

a bulbholder having a barrel shaped body with an opening at its inner lower portion, a male thread on its outer surface, first and second holes for the insertion of first and second filaments of a bulb, a female thread at its lower inner portion, and a straight trough in said opening under said first hole and extending to its bottom for accepting said first filament an isolator and a restoring spring; said first filament passing through said first hole and being bent and placed in said straight trough and being connected with a foot of said restoring spring and being blocked by said isolator;

a housing having a catch block securely connected to its top, said catch block having several shallow troughs and several hollow troughs;

a linking section being shaped as a hollow barrel and having a male thread at its top which is connected to the female thread of said bulbholder, and having several linking members with slants on bottom of each; a conducting spring located inside of said hollow body and in contact with said second filament;

an engaging section being shaped also like a hollow barrel and having a conducting post at its center, a plate with several engaging members with a slant on top of each; wherein said engaging section is inserted into a bottom portion of said linking section and wherein by changing the connection relations among said shallow troughs and said hollow troughs of said catch block, said slants of said linking members of said linking section and said slants of said engaging members of said engaging section said flashlight is turned "ON" or "OFF"; and wherein the changing of the connection relations is accomplished when said flashlight head is pressed down by a pressing force, said linking members pushing said flashlight head back up when the pressing force is released, said linking members as well as said engaging members will move up and said engaging members will be rotated from either a shallow trough or a hollow trough to a hollow trough or a shallow trough respectively.

2. An easy turning on/off flashlight as in claim 1, wherein said catch block has at its top a cut out portion and at its lower end an uncut portion and has a male thread on said cutout portion and said housing has a cover ring at its top so that the uncut portion of said catch block is blocked by said cover ring and said catch block is connected to said housing by a nut engaging said cut out portion thread; said nut has a ring trough on its top for the accommodation of a last ring of a restoring spring.

3. An easy turning on/off flashlight as in claim 1, wherein said lens assembly shoulder cooperates with said flashlight head to retain said two O rings, said lens and said conical reflector inside of said lens assembly, said lens assembly also being turnable to focus light emitted from said bulb.

4. An easy turning on/off flashlight as claimed in claims 2 or 3, wherein said flashlight head circular trough is located under said male thread of said flashlight head, said housing having two circular troughs at its upper outside portion under said cover ring, a battery cover located at a lower end of said housing having a circular trough at a corner where a threaded surface and a flat surface meet; wherein an O ring is placed in each of said circular troughs.

* * * * *